US009488192B2

(12) United States Patent
Ota et al.

(10) Patent No.: US 9,488,192 B2
(45) Date of Patent: Nov. 8, 2016

(54) COMPRESSOR, ASSEMBLING AND DISASSEMBLING DEVICE THEREFOR, AND ASSEMBLING AND DISASSEMBLING METHOD THEREFOR

(75) Inventors: Mitsuhiko Ota, Hiroshima (JP); Hideki Yamada, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 633 days.

(21) Appl. No.: 13/993,458

(22) PCT Filed: Jul. 25, 2011

(86) PCT No.: PCT/JP2011/066807

§ 371 (c)(1),
(2), (4) Date: Jun. 12, 2013

(87) PCT Pub. No.: WO2012/114555

PCT Pub. Date: Aug. 30, 2012

(65) Prior Publication Data

US 2013/0266440 A1 Oct. 10, 2013

(30) Foreign Application Priority Data

Feb. 25, 2011 (JP) ..... 2011-040719

(51) Int. Cl.
*F04D 29/64* (2006.01)
*F04D 29/60* (2006.01)
(Continued)

(52) U.S. Cl.
CPC ..... *F04D 29/60* (2013.01); *F04D 17/125* (2013.01); *F04D 29/4206* (2013.01); *F04D 29/624* (2013.01); *F04D 29/644* (2013.01); *Y10T 29/53* (2015.01)

(58) Field of Classification Search
CPC .... F04D 29/60; F04D 17/125; F04D 29/644; F04D 29/624; F04D 29/4206; F04D 29/603; F04D 29/626; F04D 29/646; F01D 25/285; F05D 2230/60; F05D 2230/70
See application file for complete search history.

(56) References Cited

U.S. PATENT DOCUMENTS 1,923,126 A 8/1933 Tucker
2,803,429 A 8/1957 Whitehead
(Continued)

FOREIGN PATENT DOCUMENTS

CN 201281047 7/2009
CN 101535649 9/2009
(Continued)

OTHER PUBLICATIONS

FLS, Inc., Translation of JP02072400U, Feb. 2016, USPTO.*
(Continued)

*Primary Examiner* — Richard Edgar
*Assistant Examiner* — Eldon Brockman
(74) *Attorney, Agent, or Firm* — Wenderoth, Lind & Ponack, L.L.P.

(57) ABSTRACT

An assembling and disassembling device for a compressor has a substantially cylindrical bundle that is received insertably and removably on an inner circumferential surface of a substantially tubular compressor casing that is mounted horizontally and further includes: a plate-like member that is provided on an axial end portion of the bundle at an opposite side of an insertion direction so as to protrude outward in a radial direction of the bundle and a threaded-rod member that inserts and removes the bundle connected to the plate-like member into and from the compressor casing by being screwed into a threaded hole provided in the plate-like member and being rotated.

3 Claims, 3 Drawing Sheets

(51) Int. Cl.

| | |
|---|---|
| ***F04D 29/42*** | (2006.01) |
| ***F04D 29/62*** | (2006.01) |
| ***F04D 17/12*** | (2006.01) |

(56) References Cited

U.S. PATENT DOCUMENTS

| | | | | |
|---|---|---|---|---|
| 3,150,820 | A | 9/1964 | Jekat et al. | |
| 5,971,702 | A * | 10/1999 | Afton | B23P 19/022 29/888.011 |
| 8,534,986 | B2 * | 9/2013 | Borer | F04D 29/624 29/281.1 |
| 8,621,873 | B2 * | 1/2014 | Robertson | F01D 25/285 248/649 |
| 2010/0162726 | A1 * | 7/2010 | Robertson | F01D 25/285 60/797 |
| 2011/0052426 | A1 * | 3/2011 | Borer | F04D 17/122 417/247 |

FOREIGN PATENT DOCUMENTS

| | | | | |
|---|---|---|---|---|
| CN | 201412396 | | 2/2010 | |
| DE | 26 56 826 | | 3/1978 | |
| DE | 27 19 850 | | 11/1978 | |
| DE | 196 17 090 | | 10/1997 | |
| DE | 297 19 605 | | 2/1998 | |
| DE | 199 19 650 | | 12/1999 | |
| DE | 199 27 765 | | 12/2000 | |
| EP | 0 050 796 | | 10/1981 | |
| EP | 2 045 472 | | 4/2009 | |
| GB | 424556 | | 2/1935 | |
| GB | 2 199 461 | | 7/1988 | |
| JP | 2-72400 | | 3/1990 | |
| JP | 02072400 U | * | 6/1990 | F04D 29/62 |
| JP | 2000-227122 | | 8/2000 | |
| JP | 2009-513863 | | 4/2009 | |

OTHER PUBLICATIONS

Notification issued Aug. 26, 2014 in corresponding European patent application No. 11859090.

Decision to Grant a Patent issued Apr. 22, 2014 in corresponding Japanese patent application No. 2011-040719.

Partial Translation of International Search Report issued Oct. 18, 2011 in International Application No. PCT/JP2011/066807.

Partial Translation of Written Opinion of the International Searching Authority issued Oct. 18, 2011 in International Application No. PCT/JP2011/066807.

Office Action issued Mar. 2, 2015 in corresponding Chinese patent application No. 201180057569.6 (with English translation).

Notification of Grant of Invention Patent issued Mar. 1, 2016 in corresponding Chinese patent application No. 201180057569.6.

Extended European Search Report issued Jul. 25, 2016 in European patent application No. 11859090.0.

* cited by examiner

COMPRESSOR, ASSEMBLING AND DISASSEMBLING DEVICE THEREFOR, AND ASSEMBLING AND DISASSEMBLING METHOD THEREFOR

BACKGROUND OF THE INVENTION

1. Technical Field

The present invention relates to a vertical split type (barrel) compressor, an assembling and disassembling device therefor, and an assembling and disassembling method therefor, and in particular, to insertion and removal thereof regarding a compressor casing and a bundle.

2. Description of the Related Art

A vertical split type compressor generally has a configuration that allows a substantially cylindrical bundle, which includes components such as rotors, blades, and so forth, to be inserted (assembled) into and removed (disassembled) from a substantially tubular compressor casing (hereinafter referred to as "casing") in the axial direction of the casing.

When the bundle is inserted into and removed from the casing in such a way, the insertion and the removal are performed by using a towing cable (see, for example, Japanese Unexamined Patent Application, Publication No. 2009-513863) and by providing a hydraulic jack on an end surface of the bundle.

In addition, Japanese Unexamined Utility Model Application, Publication No. Hei 2-72400 discloses that the bundle is inserted into and removed from the casing by using a threaded rod that is fixed to an end surface of the casing and a nut for assembling and a nut for disassembling that are screwed into the threaded rod, and by screwing and rotating the nuts about the axis of the threaded rod.

SUMMARY OF THE INVENTION

1. Technical Problem

However, with the inventions described in JP 2009-513863 and JP 2-72400, when the insertion and removal work is performed, if an external force, such as a swaying force, is applied to the compressor due to the movement during operation at sea etc., the bundle shifts in the direction orthogonal to the axial direction of the bundle, and there is a problem in which the insertion and removal work becomes difficult.

In addition, because it is necessary to change the mounting position of the hydraulic jack depending on the progress of the insertion and removal work when the insertion and removal work is performed by using the hydraulic jack, there is a problem in that the operation requires a significant amount of time.

The present invention has been conceived in light of the above-described circumstances, and an object thereof is to provide a compressor that allows the insertion and removal work to be performed with ease, an assembling and disassembling device therefor, and an assembling and disassembling method therefor.

2. Solution to the Problem

In order to solve the aforementioned problems, a compressor, an assembling and disassembling device therefor, and an assembling and disassembling method therefor according to the present invention employ the following solutions.

An assembling and disassembling device for a compressor according to a first aspect of the present invention is a assembling and disassembling device for a compressor having a substantially cylindrical bundle that is received insertably and removably on an inner circumferential surface of a substantially tubular compressor casing that is positioned horizontally, the assembling and disassembling device comprising: a plate-like member that is provided on an axial end portion of the bundle at an opposite side in an insertion direction of the bundle so as to protrude outward from the bundle in a radial direction thereof; and a threaded-rod member that inserts and removes the bundle connected to the plate-like member into and from the compressor casing by being screwed into a threaded hole provided in the plate-like member and being rotated.

The plate-like member that has the threaded hole and that is fixed to the end portion of the bundle in the axial direction and the threaded-rod member that is screwed into the threaded hole of the plate-like member are provided. Thus, the threaded-rod member rotates in the threaded hole of the plate-like member, thereby making it possible to insert and remove the bundle connected to the plate-like member into and from the compressor casing. In this way, because the threaded-rod member is screwed into the threaded hole of the plate-like member, even when the bundle experiences vertical movement due to an external force applied to the bundle during the insertion and removal work, it is possible to suppress the movement of the bundle by means of the threaded-rod member and the threaded hole of the plate-like member. Therefore, the insertion and removal work of the compressor can be performed.

The assembling and disassembling device for the compressor according to the first aspect of the present invention may further include a support member that is curved along an outer circumferential surface of the bundle and that supports the bundle from below by being provided below an axial end portion of the compressor casing at an opposite side of the casing in the insertion direction.

The support member that is curved along the outer circumferential surface of the bundle is provided below the end portion of the compressor casing at the opposite side from the insertion direction. Thus, even when the bundle experiences lateral movement due to an external force applied to the bundle during the insertion and removal work, it is possible to suppress the lateral movement of the bundle by means of the support member. Therefore, the insertion and removal work of the compressor can be performed.

A compressor according to a second aspect of the present invention is a compressor including: a substantially tubular compressor casing; and a substantially cylindrical bundle that is received insertably and removably on an inner circumferential surface of the compressor casing, wherein an axial end portion of the bundle at an opposite side in an insertion direction of the bundle is provided with a plate-like-member attaching hole for attaching a plate-like member having a threaded hole which a threaded-rod member penetrates through and the threaded-rod member is screwed with.

The bundle of the compressor is provided with the plate-like-member attaching hole for attaching the plate-like member having the threaded hole through which the threaded-rod member penetrates and into which the threaded-rod member is screwed when the bundle is inserted into and removed from the compressor casing. Thus, even when the compressor experiences vertical movement during the insertion and removal work, it is possible to suppress the vertical movement of the bundle. Therefore, it is possible to provide the compressor that allows the insertion and removal work to be easily performed under the presence of vertical movement.

A compressor assembling and disassembling method according to a third aspect of the present invention uses a compressor assembling and disassembling device, wherein the compressor assembling and disassembling device comprises: a plate-like member that protrudes outward from a substantially cylindrical bundle in a radial direction thereof, the bundle being received insertably and removably on an inner circumferential surface of a substantially tubular compressor casing that is positioned horizontally, the plate-like member being provided on an axial end portion of the bundle at an opposite side in an insertion direction of the bundle, and a threaded-rod member for inserting and removing the bundle connected to the plate-like member into and from the compressor casing by being screwed into a threaded hole provided in the plate-like member and being rotated, the compressor assembling and disassembling method comprising rotating the threaded-rod member when the bundle is inserted into and removed from the casing.

3. Advantageous Effects of the Invention

The plate-like member that has the threaded hole and that is fixed to the end portion of the bundle in the axial direction, and the threaded-rod member that is screwed into the threaded hole of the plate-like member are provided. Thus, the threaded-rod member rotates in the threaded hole of the plate-like member, thereby making it possible to insert and remove the bundle connected to the plate-like member into and from the compressor casing. In this way, because the threaded-rod member is screwed into the threaded hole of the plate-like member, even when the bundle experiences vertical movement due to an external force applied to the bundle during the insertion and removal work, it is possible to suppress the movement of the bundle by means of the threaded-rod member and the threaded hole of the plate-like member. Therefore, the insertion and removal work of the compressor can be performed.

DETAILED DESCRIPTION OF THE INVENTION

Figure 1:
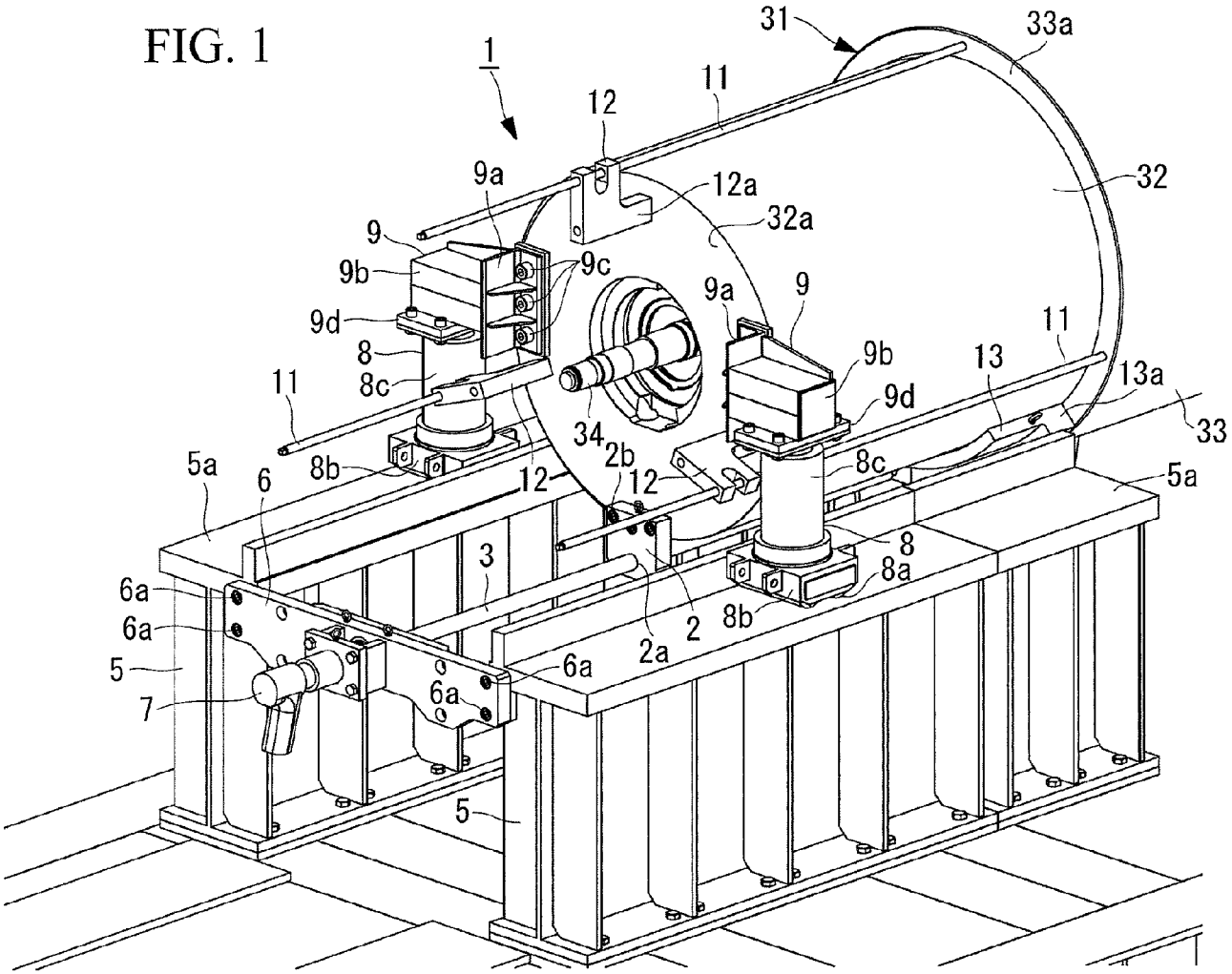
FIG. 1 is a diagram showing, in outline, the configuration of an assembling and disassembling device for a vertical split type compressor according to an embodiment of the present invention.

FIG. 1 shows a diagram showing, in outline, the configuration of an assembling and disassembling device for a vertical split type compressor according to an embodiment of the present invention, and FIGS. 2A to 2E show a procedure for removing a bundle from a compressor casing using the assembling and disassembling device shown in FIG. 1.

An assembling and disassembling device 1 is used for assembling and disassembling a vertical split type (hereinafter referred to as "barrel") compressor 31, that is mounted horizontally, by inserting and removing a substantially cylindrical bundle 32 that is received in a substantially tubular compressor casing (hereinafter referred to as "casing") 33, which are components of the compressor 31, so that the bundle 32 is insertable and removable from the inner circumferential surface of the casing 33.

The assembling and disassembling device 1 is principally provided with a travelling plate (plate-like member) 2 that is provided on an axial end surface (end portion) 32*a* of the bundle 32 at the opposite side in the insertion direction of the bundle 32, that is to be inserted into the casing 33, so as to protrude outward in the radial direction of the bundle 32, and a travelling rod (threaded-rod member) 3 that inserts and removes the bundle 32 connected to the travelling plate 2 into and from the casing 33 by being screwed into a threaded hole 2*a* provided in the travelling plate 2 and being rotated.

The compressor 31 is principally constructed of the substantially cylindrical bundle 32, which includes components such as a rotor 34, blades (not shown), and so forth, in the interior thereof, and the substantially tubular casing 33. The casing 33 is installed on an upper surface of a compressor holder (not shown) such that its axial direction extends horizontally. The end surface 32*a* of the bundle 32 is provided with travelling-plate attaching holes (plate-like-member attaching holes) for attaching the travelling plate 2, and an end surface 33*a*, which will be described below, of the casing 33 is provided with bundle support attaching holes (not shown) for fixing a bundle support (support member) 13.

The compressor 31 of this embodiment is mounted on ships or a floating production storage & offloading unit (FPSO: Floating Production Storage & Offloading unit).

The travelling plate 2 has a substantially quadrangular shape and is fixed to the lower part of the end surface 32*a* of the bundle 32 by a plurality of bolts 2*b* so as to protrude outward in the radial direction of the bundle 32. The travelling plate 2 that protrudes outward in the radial direction of the bundle 32 is provided with, at one location, the threaded hole 2*a* into which the travelling rod 3 is screwed.

The travelling rod 3 is a feed screw having a screw thread on its outer circumferential surface over the entire length in the axial direction thereof. A trapezoidal screw thread having a trapezoidal shape is used as the screw thread of the travelling rod 3. A first end of the travelling rod 3 penetrates the travelling plate 2 by being screwed into the threaded hole 2*a* provided in the travelling plate 2. The first end of the travelling rod 3 penetrating the travelling plate 2 is in contact with the bundle support 13, which will be described below.

The axial direction of the travelling rod 3 extends in substantially the same direction as the lengthwise direction of rails 5*a* provided on the upper surface of bases 5, which will be described below. The second end of the travelling rod 3 extending towards the left direction in FIG. 1 from the travelling plate 2 penetrates through substantially the center portion of a travelling support 6, which will be described below, in the lengthwise direction. An air wrench 7 is provided on the second end of the travelling rod 3 penetrating the travelling support 6.

Two bases 5 are provided under the bundle 32. The bases 5 are provided such that their extension directions are both in substantially the same direction as the axial direction of the compressor 31 and are in parallel with each other. Formed on the upper surface of each of the bases 5 is the rail 5*a*, on which a side roller 8, which will be described below, rolls.

The travelling support 6 is fixed to the end portions of the respective bases 5 by bolts 6*a* so as to connect the lengthwise end portions of the two bases 5 to each other. The travelling support 6 has a substantially rectangular shape and is provided with a threaded hole (not shown) at substantially the center portion in the lengthwise direction thereof. The travelling rod 3 described above is screwed into and penetrates through the threaded hole provided in the travelling support 6.

The air wrench 7 provided on the second end of the travelling rod 3 drives the travelling rod 3 by being driven by air.

As shown in FIG. 1, the side rollers 8 are provided so as to extend downwards at two locations on the outer edge of the end surface 32*a* of the bundle 32 constituting the compressor 31. The side rollers 8 provided at the two locations on the outer edge of the end surface 32*a* are provided on the outer edge of the end surface 32*a* of the bundle 32 such that an imaginary line connecting the side rollers 8 extends horizontally and orthogonally to the lengthwise direction of the rails 5*a*.

The side rollers 8 are provided with rollers 8*a* that can roll on the rails 5*a*, roller casings 8*b* that house the rollers 8*a*, and substantially cylindrical leg portions 8*c* that extend upwards from the roller casings 8*b*.

The rollers 8*a* are wheels that can roll on the rails 5*a*. The rollers 8*a* are housed in the roller casings 8*b*. The rollers 8*a* housed in the roller casings 8*b* are in contact with the rails 5*a* by, as shown in FIG. 1, protruding downwards from the lower surface of the roller casings 8*b*. The leg portions 8*c*, having a substantially cylindrical shape, are provided on the upper surfaces of the roller casings 8*b* so as to extend substantially vertically upwards.

The upper ends of the leg portions 8*c* of the side rollers 8 are provided with connectors 9 that connect the side rollers 8 and the end surface 32*a* of the bundle 32. The connectors 9 principally have L-shaped fittings 9*a* and cuboid members 9*b*.

One surface of the L-shaped fittings 9*a* is connected to the end surface that is orthogonal to the lengthwise direction of the cuboid members 9*b*, and the other surface of the L-shaped fittings 9*a* is connected to the end surface 32*a* of the bundle 32 by screws 9*c*. As shown in FIG. 1, the cuboid members 9*b* that are connected to the end surface 32*a* of the bundle 32 through the L-shaped fittings 9*a* are provided such that one lengthwise end protrudes outward from the bundle 32 in the radial direction of the bundle 32.

Flange portions 9*d* are provided on the side surfaces which are provided at the lower portions of the cuboid members 9*b*. The lower surfaces of thus-provided flange portions 9*d* are in contact with the upper ends of the leg portions 8*c*.

The end surface (end portion) 33*a* of the casing 33 at the opposite side in the insertion direction of the bundle 32 is provided with puller rods 11 at three locations. The puller rods 11 are inserted into respective holes (not shown) provided in the end surface 33*a* of the casing 33 so as to be arranged in the circumferential direction at substantially equal intervals.

The puller rods 11 extend such that their axes are substantially parallel to the major axis of the casing 33. As shown in FIG. 1, the three thus-configured puller rods 11 extend substantially parallel to the major axis of the bundle 32 when the bundle 32 is inserted into and removed from the casing 33.

Puller pieces 12 are respectively provided at intermediate positions on the individual puller rods 11 that are provided so as to extend substantially parallel to the major axis of the bundle 32 from the end surface 33*a* of the casing 33. The puller pieces 12 are provided so as to be in contact with the end surface 32*a* of the bundle 32.

The puller pieces 12 are plate-like pieces having a substantially rectangular shape. The puller pieces 12 having the substantially rectangular shape are provided such that their major axis direction (lengthwise direction of the substantially rectangular shape) extends orthogonally relative to the axial direction of the puller rods 11. Protruding portions 12*a* that protrude towards the bundle 32 are provided on the lower portions of the width end surfaces of the plate-like puller pieces 12. Tip portions of the protruding portions 12*a* are in contact with the end surface 32*a* of the bundle 32.

The puller pieces 12 having the protruding portions 12*a* are provided with, in the width direction thereof, through holes (not shown) through which the puller rods 11 can penetrate the puller pieces 12 in the minor axis direction (crosswise direction of the substantially rectangular shape). These through holes have an inner diameter substantially larger than the outer diameter of the puller rods 11 such that the puller pieces 12 are slidably movable in the axial direction of the puller rods 11 and have a size that does not allow easy rotation of the puller pieces 12 around the axis of the puller rods 11.

In addition, the bundle support 13 is provided at the lower part near the end surface 33*a* of the casing 33. The bundle support 13 is provided at the lower portion of the axial end portion of the casing 33 and supports the bundle 32 from below. The bundle support 13 extends substantially parallel to and in substantially the same direction as the axial direction of the casing 33 from the end surface 33*a* of the casing 33. The bundle support 13 has a shape that is curved along the outer circumferential surface of the bundle 32 and that is curved in a convex shape towards the downward direction.

The bundle support 13 has a flange portion 13*a* at the side contacting the end surface 33*a* of the casing 33. The bundle support 13 is connected by fixing the flange portion 13*a* to the end surface 33*a* of the casing 33 by screws (not shown). In addition, the first end of the travelling rod 3 mentioned above is in contact with the opposite end of the bundle support 13 relative to the end of the flange portion 13*a*.

A procedure for removing the bundle 32 from the casing 33 of the compressor 31 using the assembling and disassembling device 1 with such a configuration will be explained using FIGS. 2A to 2E.

Figure 2A:
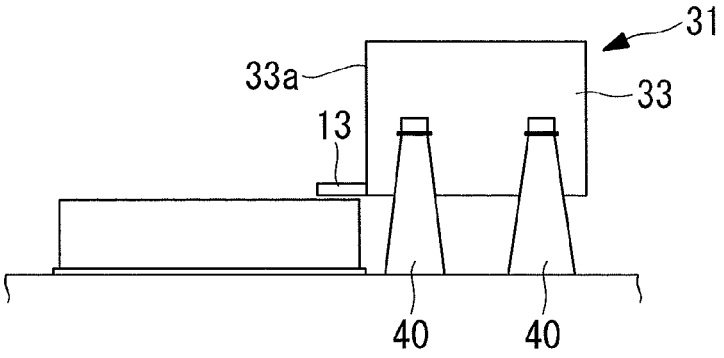
FIG. 2A is a diagram showing a procedure for removing a bundle from a casing using the assembling and disassembling device shown in FIG. 1.

As shown in FIG. 2A, the compressor 31 that incorporates the bundle 32 in the casing 33 is installed on compressor holders 40 so as to be supported thereby.

The bundle support 13 becomes attached on the under portion of the end surface 33*a* of the casing 33 of the compressor 31 that is installed on the compressor holders 40. Here, the bundle support 13 is fixed so as to be curved in a shape that is convex in the downward direction.

Figure 2B:
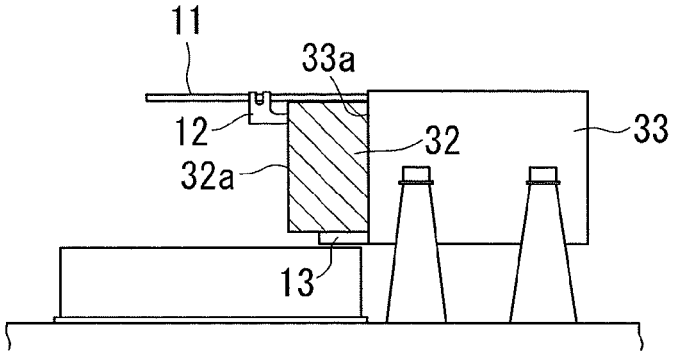
FIG. 2B is a diagram showing a procedure for removing a bundle from a casing using the assembling and disassembling device shown in FIG. 1.

Next, a hydraulic jack (not shown) is disposed on the opposite-end surface (the end surface of the bundle 32 in the axial direction, which is the integration direction into the casing 33) of the bundle 32. By supplying hydraulic pressure to the hydraulic jack disposed on the opposite-end surface (not shown) of the bundle 32, the bundle 32 is pushed in the direction for removing the bundle 32 (to the left in FIG. 2A). By doing so, as shown in FIG. 2B, the end surface 32*a* side of the bundle 32 is removed from the casing 33. The bundle 32 removed from the casing 33 is supported by the bundle support 13 from below.

Next, as shown in FIG. 2B, the puller rods 11 become attached on the end surface 33*a* of the casing 33. The puller rods 11 are arranged at three locations on the end surface 33*a* in the circumferential direction at substantially equal intervals.

The puller pieces 12 become inserted into the respective puller rods 11 disposed on the end surface 33*a* of the casing 33 from the extending-end side of the puller rods 11 (left side in FIG. 2B). At this time, the puller pieces 12 are inserted into the puller rods 11 such that their protruding portions 12*a* (see FIG. 1) are located at the end surface 32*a* side of the bundle 32.

The puller pieces 12 are provided by adjusting their positions on the puller rods 11 such that their protruding portions 12*a* are in contact with the end surface 32*a* of the bundle 32. By doing so, the puller pieces 12 support the bundle 32 from the end surface 32*a* side.

Figure 2C:
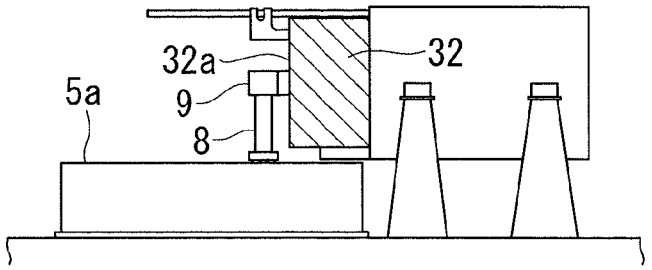
FIG. 2C is a diagram showing a procedure for removing a bundle from a casing using the assembling and disassembling device shown in FIG. 1.

Next, as shown in FIG. 2C, the side rollers 8 become attached, through the connectors 9, at two locations on the outer edge of the end surface 32*a* of the bundle 32. At this time, the side rollers 8 are attached such that the rollers 8*a* of the side rollers 8 (see FIG. 1) are brought into contact with the rails 5*a*.

Figure 2D:
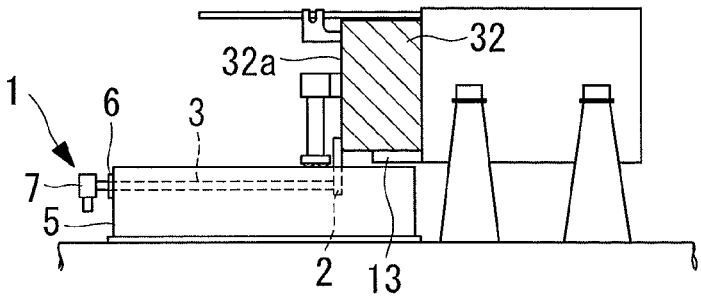
FIG. 2D is a diagram showing a procedure for removing a bundle from a casing using the assembling and disassembling device shown in FIG. 1.

Next, as shown in FIG. 2D, the assembling and disassembling device 1 is provided on the end surface 32*a* of the bundle 32.

Here, the assembling and disassembling device 1 becomes assembled by screwing the travelling plate 2 to the travelling rod 3 and by screwing the travelling support 6 to the second end portion of the travelling rod 3. In this way, the first end of the travelling rod 3 of the assembled assembling and disassembling device 1 is brought into contact with the bundle support 13, and the travelling support 6 is fixed to the end portions of the two bases 5 by the bolts 6*a* (see FIG. 1).

In addition, the travelling plate 2 screwed on the travelling rod 3 and the end surface 32*a* of the bundle 32 become connected by the bolts 2*b* (see FIG. 1). By doing so, the assembling and disassembling device 1 is disposed on the end surface 32*a* of the bundle 32, and furthermore, the air wrench 7 becomes attached on the end portion of the travelling rod 3.

Figure 2E:
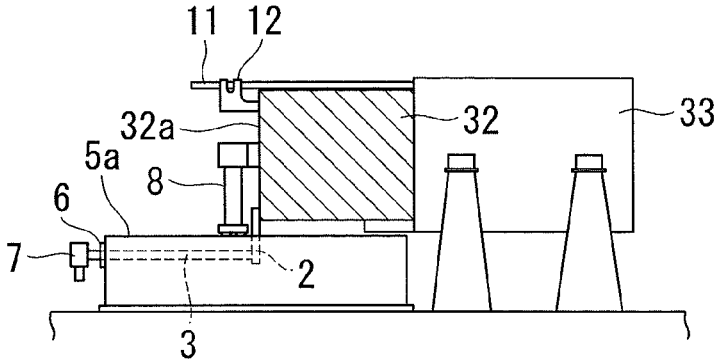
FIG. 2E is a diagram showing a procedure for removing a bundle from a casing using the assembling and disassembling device shown in FIG. 1.

Lastly, as shown in FIG. 2E, by driving the air wrench 7, the air wrench 7 rotates the travelling rod 3 clockwise in the direction towards the end surface 32*a* side of the bundle 32. By rotating the travelling rod 3 clockwise, the travelling plate 2 is moved to the left in FIG. 2E.

Because the travelling plate 2 is fixed to the end surface 32*a* of the bundle 32, as the travelling plate 2 is moved to the left in FIG. 2E, the bundle 32 is removed from the casing 33. At this time, the individual side rollers 8 provided on the end surface 32*a* of the bundle 32 roll on the rails 5*a*, and the individual puller pieces 12 are moved in a sliding manner to the left in FIG. 2E along the individual puller rods 11 while being in contact with the end surface 32*a*.

In this way, even when ships or Floating Production Storage & Offloading unit experience pitching (vertical movement) during removal of the bundle 32 from the casing 33, because the travelling rod 3 is screwed into the threaded hole 2*a* of the travelling plate 2 (see FIG. 1), it is possible to suppress the movement of the bundle 32 that is connected to the travelling plate 2 in the direction perpendicular to its axial direction (the vertical direction in FIGS. 2A to 2E).

Furthermore, even when ships or Floating Production Storage & Offloading unit experience rolling (lateral movement), because the bundle 32 is supported from below by the bundle support 13 that has a shape corresponding to the outer circumferential shape of the bundle 32, it is possible to suppress the movement of the bundle 32 in the direction horizontally orthogonal to its axial direction (lateral direction).

Next, a method for inserting the bundle 32 into the casing 33 of the compressor 31 using the assembling and disassembling device 1 of the present invention will be explained using FIG. 1.

As shown in FIG. 1, the assembling and disassembling device 1, the side rollers 8, the bundle support 13, the puller pieces 12, and so forth are set in place. The air wrench 7 provided on the end portion of the travelling rod 3 is driven. By doing so, the air wrench 7 rotates the travelling rod 3 anti-clockwise in the direction towards the end surface 32*a* side of the bundle 32. By rotating the travelling rod 3 anti-clockwise, the travelling plate 2 is moved to the right in FIG. 1.

Because the travelling plate 2 is fixed to the end surface 32*a* of the bundle 32, as the travelling plate 2 is moved to the right in FIG. 1, the bundle 32 is inserted into the casing 33. At this time, the individual side rollers 8 provided on the end surface 32*a* of the bundle 32 roll on the rails 5*a*, and the individual puller pieces 12 are slidably moved to the right in FIG. 1 along the individual puller rods 11 while being in contact with the end surface 32*a*. The anti-clockwise rotation of the travelling rod 3 is continued until the bundle 32 is completely received into the casing 33.

As described above, according to the compressor 31, the assembling and disassembling device 1 for the compressor 31, and the assembling and disassembling method therefor of this embodiment, the following advantageous effects can be afforded.

The travelling plate (plate-like member) 2 that has the threaded hole 2*a* and that is fixed to the end surface (end portion) 32*a* located at the opposite side from the insertion direction, that is the axial direction of the bundle 32, and the travelling rod (threaded-rod member) 3 that is screwed into and penetrates through the threaded hole 2*a* of the travelling plate 2 are provided. Thus, by rotating the travelling rod 3, it is possible to insert and remove the bundle 32 that is connected to the travelling plate 2 into and from the casing (compressor casing) 33. In this way, because the travelling rod 3 is screwed into the threaded hole 2*a* of the travelling plate 2, even when the bundle 32 experiences vertical movement due to an external force applied to the bundle 32 during the insertion and removal work, it is possible to suppress the movement of the bundle 32 by means of the travelling rod 3 and the threaded hole 2*a* of the travelling plate 2. Therefore, the insertion and removal work of the compressor 31 can be performed.

The bundle support (support member) 13 that is curved along the outer circumferential surface of the bundle 32 is provided below the end surface (end portion) 33*a* of the casing 33 at the opposite side from the insertion direction. Thus, even when the bundle 32 experiences lateral movement due to an external force applied to the compressor 31 during the insertion and removal work, it is possible to suppress the lateral movement of the bundle 32 by means of the bundle support 13. Therefore, the insertion and removal work of the compressor 31 can be performed.

The bundle 32 is provided with the travelling-plate attaching hole (plate-like-member attaching hole) for attaching the travelling plate 2 having the threaded hole 2*a* through which the travelling rod 3 penetrates and into which the travelling rod 3 is screwed when the bundle 32 is inserted into and removed from the casing 33. Thus, even when the compressor 31 experiences vertical movement during the insertion and removal work, it is possible to suppress the vertical movement of the bundle 32. Therefore, it is possible to provide the compressor 31 that allows the insertion and removal work to be performed easily under the presence of vertical movement.

REFERENCE SIGNS LIST

1 assembling and disassembling device
2 plate-like member (travelling plate)
2*a* threaded hole
3 threaded-rod member (travelling rod)
31 compressor
32 bundle
32*a* end portion (end surface)
33 compressor casing (casing)

The invention claimed is:

1. An assembling and disassembling device for a compressor having a substantially cylindrical bundle that is received insertably and removably on an inner circumferential surface of a substantially tubular compressor casing that is positioned horizontally, the assembling and disassembling device comprising:

a plate-like member that is connected to an axial end portion of the bundle at an opposite side in an insertion direction of the bundle so as to protrude outward from the bundle in a radial direction thereof; and a threaded-rod member that is rotatably received in a threaded hole provided in the plate-like member such that the bundle can be inserted and removed from the compressor casing by rotating the threaded-rod member; and a support member that is curved along an outer circumferential surface of the bundle, the support member supporting the bundle from below by being provided below an axial end portion of the compressor casing at an opposite side of the casing in the insertion direction, wherein one end of the threaded-rod member penetrating the plate-like member is in contact with an end of the support member, and an opposite end of the support member is in contact with an end surface of the compressor casing.

2. A compressor comprising:

a substantially tubular compressor casing; and a substantially cylindrical bundle that is received insertably and removably on an inner circumferential surface of the compressor casing, wherein an axial end portion of the bundle at an opposite side in an insertion direction of the bundle is provided with a plate-like-member attaching hole for attaching a plate-like member having a threaded hole through which a threaded-rod member penetrates and the threaded-rod member is threadably engaged with the threaded through hole, wherein a support member that is curved along an outer circumferential surface of the bundle supports the bundle from below by being provided below an axial end portion of the compressor casing at an opposite side of the casing in the insertion direction, and wherein one end of the threaded-rod member penetrating the plate-like member is in contact with an end of the support member, and an opposite end of the support member is in contact with an end surface of the compressor casing.

3. A compressor assembling and disassembling method using a compressor assembling and disassembling device, wherein the compressor assembling and disassembling device comprises:

a plate-like member that protrudes outward from a substantially cylindrical bundle in a radial direction thereof, the bundle being received insertably and removably on an inner circumferential surface of a substantially tubular compressor casing that is positioned horizontally, the plate-like member being provided on an axial end portion of the bundle at an opposite side in an insertion direction of the bundle;

a threaded-rod member that is rotatably received in a threaded hole provided in the plate-like member so that the bundle can be inserted and removed from the compressor casing by screwing the threaded-rod member into the threaded hole; and a support member that is curved along an outer circumferential surface of the bundle and that supports the bundle from below by being provided below an axial end portion of the compressor casing at an opposite side of the casing in the insertion direction, the compressor assembling and disassembling method comprising:

contacting one end of the threaded-rod member penetrating the plate-like member with an end of the support member, and an opposite end of the support member is in contact with an end surface of the compressor casing; and rotating the threaded-rod member to insert or remove the bundle from the casing.

* * * * *